US011199043B2

(12) United States Patent
Kim

(10) Patent No.: US 11,199,043 B2
(45) Date of Patent: Dec. 14, 2021

(54) HORIZONTALLY SLIDING WINDOW

(71) Applicant: Choong Kuk Kim, Gyeongsangnam-do (KR)

(72) Inventor: Choong Kuk Kim, Gyeongsangnam-do (KR)

( * ) Notice: Subject to any disclaimer, the term of this patent is extended or adjusted under 35 U.S.C. 154(b) by 180 days.

(21) Appl. No.: 16/316,442

(22) PCT Filed: Aug. 7, 2017

(86) PCT No.: PCT/KR2017/008524
§ 371 (c)(1),
(2) Date: Jan. 9, 2019

(87) PCT Pub. No.: WO2018/030740
PCT Pub. Date: Feb. 15, 2018

(65) Prior Publication Data

US 2020/0181970 A1 Jun. 11, 2020

(30) Foreign Application Priority Data

Aug. 12, 2016 (KR) ..... 10-2016-0102989

(51) Int. Cl.
*E06B 3/46* (2006.01)
*E05D 15/06* (2006.01)

(52) U.S. Cl.
CPC ..... *E06B 3/4609* (2013.01); *E05D 15/0665* (2013.01); *E05Y 2900/148* (2013.01)

(58) Field of Classification Search
CPC ..... E06B 3/4609; E06B 3/26347; E06B 3/46; E05D 15/0665; E05Y 2900/18
See application file for complete search history.

(56) References Cited

U.S. PATENT DOCUMENTS 3,225,393 A * 12/1965 Coller ..... E04C 2/384 49/213
3,324,597 A * 6/1967 Samuel Rich ..... E06B 3/4618 49/406

(Continued)

FOREIGN PATENT DOCUMENTS

JP 02-210180 A 8/1990
KR 20-0344363 Y1 3/2004

(Continued)

OTHER PUBLICATIONS

KR Office Action dated Aug. 30, 2016 as received in Application No. 10-2016-0102989.

(Continued)

*Primary Examiner* — Justin B Rephann
(74) *Attorney, Agent, or Firm* — Maschoff Brennan

(57) ABSTRACT

A horizontally sliding window can block a draft, rainwater, dust, and noise from being introduced through a gap between a window casing and a window while the window is closed, thereby improving indoor heat insulating and soundproof functions of the window. A horizontally sliding window includes a square frame-shaped window casing having a transverse frame and a longitudinal frame assembled therein and a window disposed on an inner side of the window casing. Moving frames are respectively interposed between the transverse frame and an upper end portion of the window and between the transverse frame and a lower end portion of the window, each including first and second cover members extending from opposite sides thereof to cover indoor and outdoor sides of the transverse frame, respectively, and having a roller rotatably coupled between the first and second cover members so as to operate in contact with the transverse frame.

3 Claims, 4 Drawing Sheets

(56) References Cited

U.S. PATENT DOCUMENTS 3,584,417 A * 6/1971 Gatton ..... F25D 23/021 49/404
4,202,137 A * 5/1980 Randall ..... E06B 3/26347 49/458
5,884,361 A * 3/1999 Richardson ..... E05D 15/0665 16/100
7,555,871 B1 * 7/2009 Neal ..... E05D 15/0621 49/409
2003/0201071 A1 * 10/2003 Kobayashi ..... E06B 9/52 160/10
2007/0062122 A1 * 3/2007 Polus ..... E06B 3/4609 49/425
2008/0190030 A1 * 8/2008 Cheon ..... E06B 3/4609 49/425
2009/0038228 A1 * 2/2009 Lee ..... E06B 3/4627 49/360
2014/0137476 A1 * 5/2014 Kim ..... E06B 7/232 49/305
2015/0121764 A1 * 5/2015 Lee ..... E05D 15/0678 49/420
2018/0038144 A1 * 2/2018 Metzger ..... E06B 3/26

FOREIGN PATENT DOCUMENTS

KR 20-0402974 Y1 12/2005
KR 10-2009-0107613 A 10/2009
KR 10-2011-0133779 A 12/2011
KR 10-1320830 B1 10/2013

OTHER PUBLICATIONS

KR Office Action dated Feb. 22, 2017 as received in Application No. 10-2016-0102989.

* cited by examiner

HORIZONTALLY SLIDING WINDOW

TECHNICAL FIELD

The present invention relates to a horizontally sliding window, and more particularly to a capable of blocking draft, rain, dust, and noise introduced through a gap between a window casing and a window while the window is closed, thereby having improved insulation and soundproofing functions.

BACKGROUND ART

In general, windows, which are installed in buildings or houses, serve to block the insides of the buildings from the outside when the window is closed and to allow ventilation when the window is open. Generally, guide grooves are formed in two rows in a window casing, and first and second windows including glass panes are installed to move in a sliding manner on the guide grooves and be staggered from each other.

As an example of such conventional windows, Korean Patent Application Publication No. 10-2011-0133779 (published on Dec. 14, 2011) proposed a sliding window constituted of a window casing installed on a wall of a normal building and provided with a double row rail; and windows including a glass pane coupled to each thereof and window frames installed to be openable/closable in a sliding manner. Here, a roller seated on a rail of the window casing is coupled with a rail groove formed between both rail frames, and mohair is coupled to T-shaped inner grooves formed at inner sides of the both rail frames.

However, since, in the case of such a conventional window, substantial gaps are always formed between an inner upper end of a window casing and upper ends of window frames such that the window frame can be placed in the window casing or separated therefrom, there is a problem that external wind or noise is introduced into the room through the gaps.

DISCLOSURE

Technical Problem

Therefore, the present invention has been made in view of the above problems, and it is one object of the present invention to provide a horizontally sliding window capable of blocking draft, rain, dust, and noise introduced through a gap between a window casing and a window while the window is closed, thereby having improved insulation and soundproofing functions.

Technical Solution

In accordance with an aspect of the present invention, the above and other objects can be accomplished by the provision of a horizontally sliding window including a square frame-shaped window casing formed by assembling transverse frames and longitudinal frames; a window disposed on an inner side of the window casing; and a movable frame which is interposed between an upper end of the transverse frames and an upper end of the window and between a lower end of the transverse frames and a lower end of the window, from both sides of which a first cover member for covering an indoor side of the transverse frames and a second cover member for covering an outdoor side of the transverse frames respectively extend, and which comprises rollers rotatably coupled between the first and second cover members so as to operate in contact with the transverse frames.

In accordance with a preferred aspect of the present invention, a guide protrusion for guiding the first cover member when the movable frame moves in a sliding manner may protrude from indoor sides.

In accordance with another aspect of the present invention, there is provided a horizontally sliding window including a square frame-shaped window casing formed by assembling transverse frames, which are divided into a first rail part located on an indoor side and a second rail part located on an outdoor side, with longitudinal frames; a first window disposed on the first rail part on an inner side of the window casing; a second window disposed on the second rail part on an inner side of the window casing; a first movable frame which is interposed between an upper end of the first rail part and an upper end of the first window and between a lower end of the first rail part and a lower end of the first window, from both sides of which a first cover member for covering an indoor side of the first rail part and a second cover member to be coupled with the second rail part respectively extend, and which includes rollers rotatably coupled between the first and second cover members so as to operate in contact with the first rail part; and a second movable frame which is interposed between an upper end of the second rail part and an upper end of the second window and between a lower end of the second rail part and a lower end of the second window, from both sides of which a third cover member for covering an indoor side of the second rail part and a fourth cover member for covering an outdoor side of the second rail part respectively extend, and which includes rollers rotatably coupled between the third and fourth cover members so as to operate in contact with the second rail part.

In accordance with a preferred aspect of the present invention, the height of the second rail part of the transverse frames may be higher than that of the first rail part thereof.

In accordance with a preferred aspect of the present invention, a hook piece may protrude in an indoor side direction of the second rail part to be bent in the vicinity of the first rail part, and the second cover member may extend straight and then may be bent toward an outdoor side so as to engage with the hook piece.

In accordance with a preferred aspect of the present invention, a guide protrusion for guiding the first cover member when the first movable frame moves in a sliding manner may protrude from an indoor side of the first rail part.

Advantageous Effects

As apparent from the foregoing, the present invention advantageously provides a horizontally sliding window having a structure wherein a movable frame for covering indoor and outdoor sides of a window casing is respectively installed at upper and lower parts of a window. Accordingly, the window is firmly and stably coupled to the window casing and maintained in the coupled state without being separated therefrom, and can block introduction of draft, rain, dust, noise, and the like into an indoor side while the window is closed, thereby providing improved insulation and soundproofing functions.

BEST MODE

Figure 1:
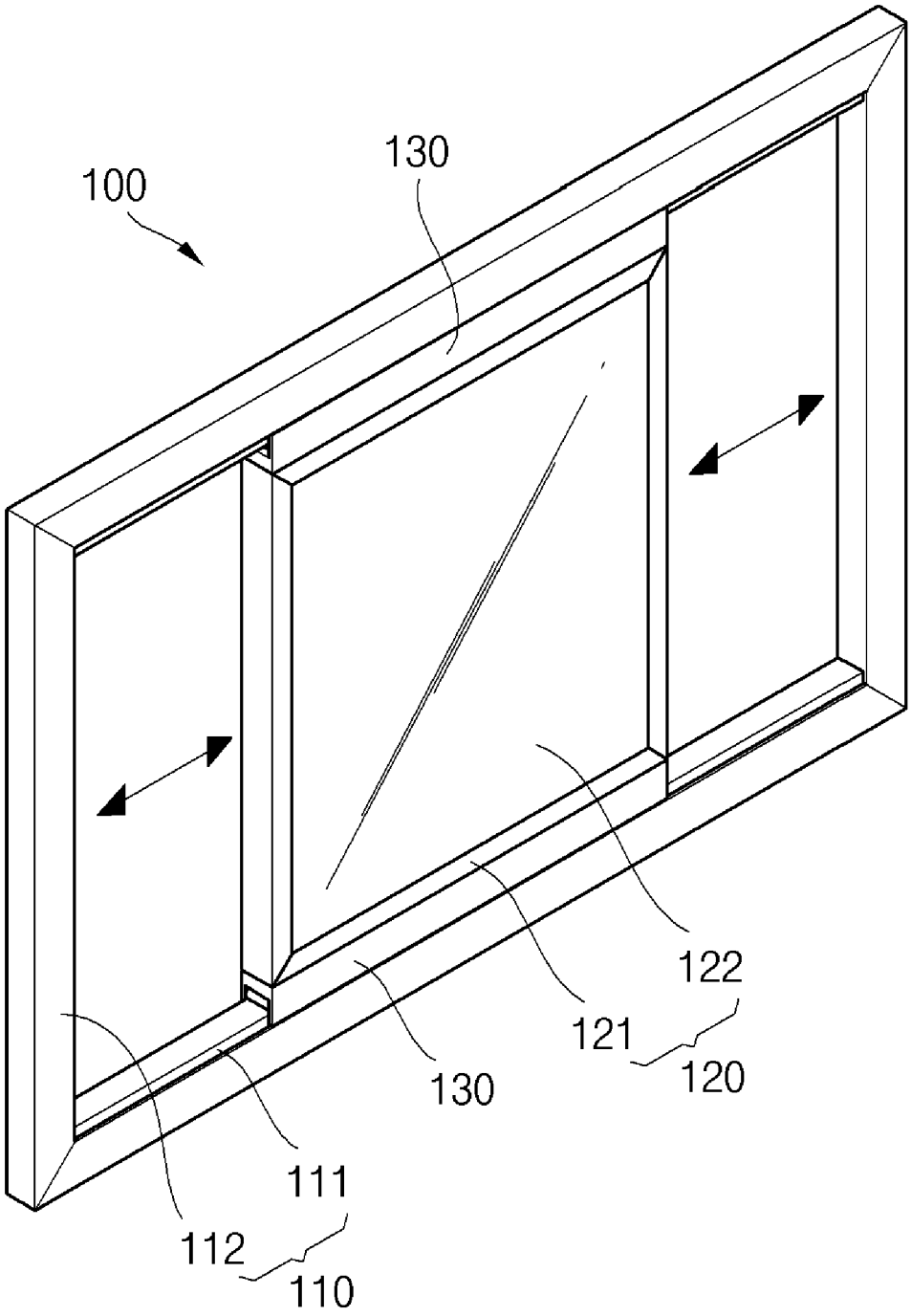
FIG. 1 illustrates a schematic perspective view of a horizontally sliding window according to a first example of the present invention.

Exemplary embodiments of the present invention are described in detail with reference to the accompanying drawings. The embodiments are provided for illustrative purposes only so as for those of ordinary skill in the art to easily implement the present invention and should not be construed as limiting the scope and spirit of the present invention.

To clearly describe the present invention, a part without concerning to the description is omitted in the drawings, and like reference numerals in the specification denote like elements.

Throughout this specification, unless explicitly described to the contrary, the word "comprise" and variations such as "comprises" or "comprising", will be understood to imply the inclusion of stated elements but not the exclusion of any other elements.

Figure 2:
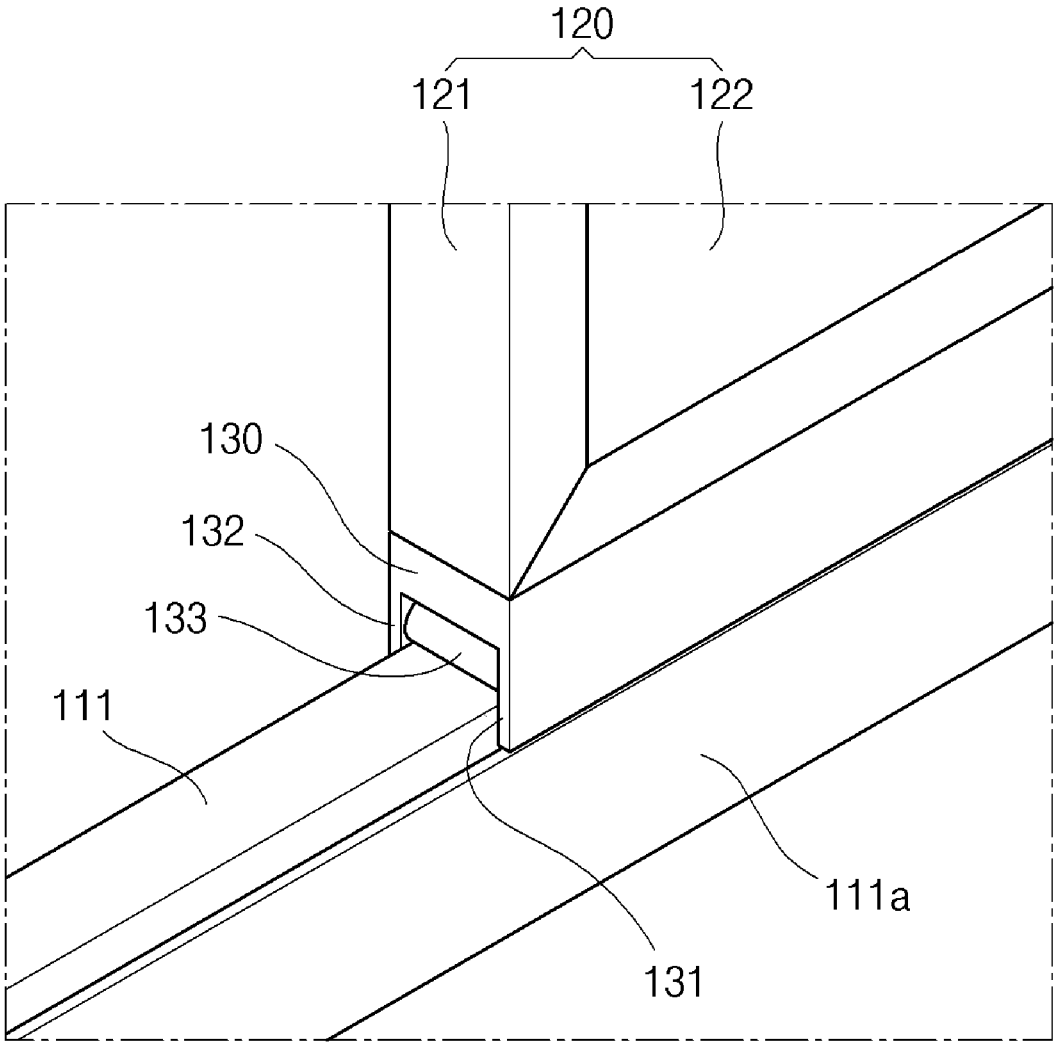
FIG. 2 illustrates an enlarged perspective view of a grooved part of the horizontally sliding window shown in FIG. 1.

FIG. 1 illustrates a schematic perspective view of a horizontally sliding window according to a first example of the present invention, and FIG. 2 illustrates an enlarged perspective view of a grooved part of the horizontally sliding window shown in FIG. 1.

A horizontally sliding window 100 according to the first example of the present invention includes a window casing 110, a window 120, and a movable frame 130, as illustrated in FIGS. 1 and 2.

Here, the window casing 110 is mounted in an opening of an outer wall of a building and serves as a rail such that the window 120 can move in a sliding manner via the movable frame 130. The window casing 110 has a square frame shape wherein a pair of transverse frames 111 and a pair of longitudinal frames 112 are mutually assembled.

Since surfaces, which contact a roller 133 coupled to the movable frame 130, of the transverse frames 111 of the window casing 110 are flat, unlike general window casings, cleaning is simple and easy.

Here, a guide protrusion 111*a* protrudes from indoor sides of the transverse frames 111. A first cover member 131 of the movable frame 130 is seated on the guide protrusion 111*a* to guide the movable frame 130 to move in a sliding manner.

In addition, the window 120 moves in a sliding manner by the movable frame 130 thereof in an inner side of the window casing 110, thereby opening or closing an inner space of the window casing 110. The window 120 is constituted of a square frame-shaped window frame 121; and a glass pane 122 provided inside the window frame 121.

Meanwhile, the movable frame 130, which is interposed between the transverse frames 111 of the window casing 110 and the window frame 121 of the window 120, is fixed to each of upper and lower ends of the window frame 121 such that the window frame 121 can move in a sliding manner.

In particular, the first cover member 131 for covering an indoor side of the transverse frames 111 and a second cover member 132 for covering an outdoor side of the transverse frames 111 respectively extend from both sides of the movable frame 130.

The first cover member 131 extends straight in the vicinity of the guide protrusion 111*a* of the transverse frames 111, and the second cover member 132 extends straight so as to be located at almost half of an outdoor side of the transverse frames 111. Here, the lengths of the first and second cover members 131 and 132 are not specifically limited and may be the same or different.

Accordingly, since the movable frame 130 has a structure wherein the first and second cover members 131 and 132 extend to respectively cover indoor and outdoor sides of the transverse frames 111, the window 120 is not released when moved in a sliding manner on the transverse frames 111, and introduction of draft, rain, dust, and noise into an indoor side can be doubly prevented while the window 120 is closed.

In addition, an end of the movable frame 130 is rotatably coupled to the first cover member 131, another end thereof is rotatably coupled to the second cover member 132, and a plurality of rollers 133 driven on the transverse frames 111 to be in contact therewith are provided at regular intervals.

A material of the roller 133 is not specifically limited, and is preferably rubber or high-hardness urethane to have excellent grip force when brought into contact with the transverse frames 111.

Accordingly, frictional force with the transverse frames 111 is strengthened, so that the roller 133 can rotate in a state of being in tight contact with the transverse frames 111 without spinning when the movable frame 130 moves in a sliding manner.

Figure 3:
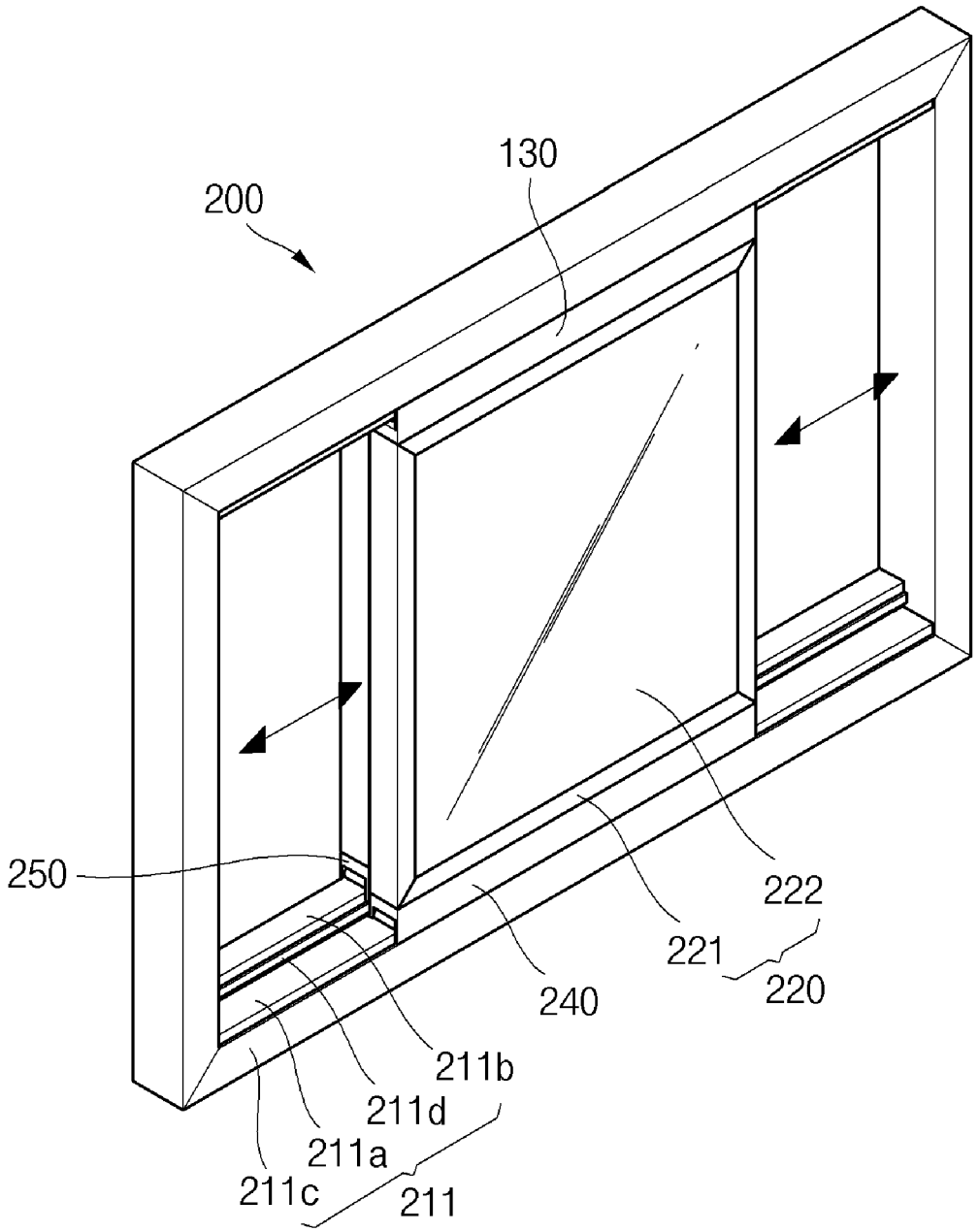
FIG. 3 illustrates a schematic perspective view of a horizontally sliding window according to a second example of the present invention.
Figure 4:
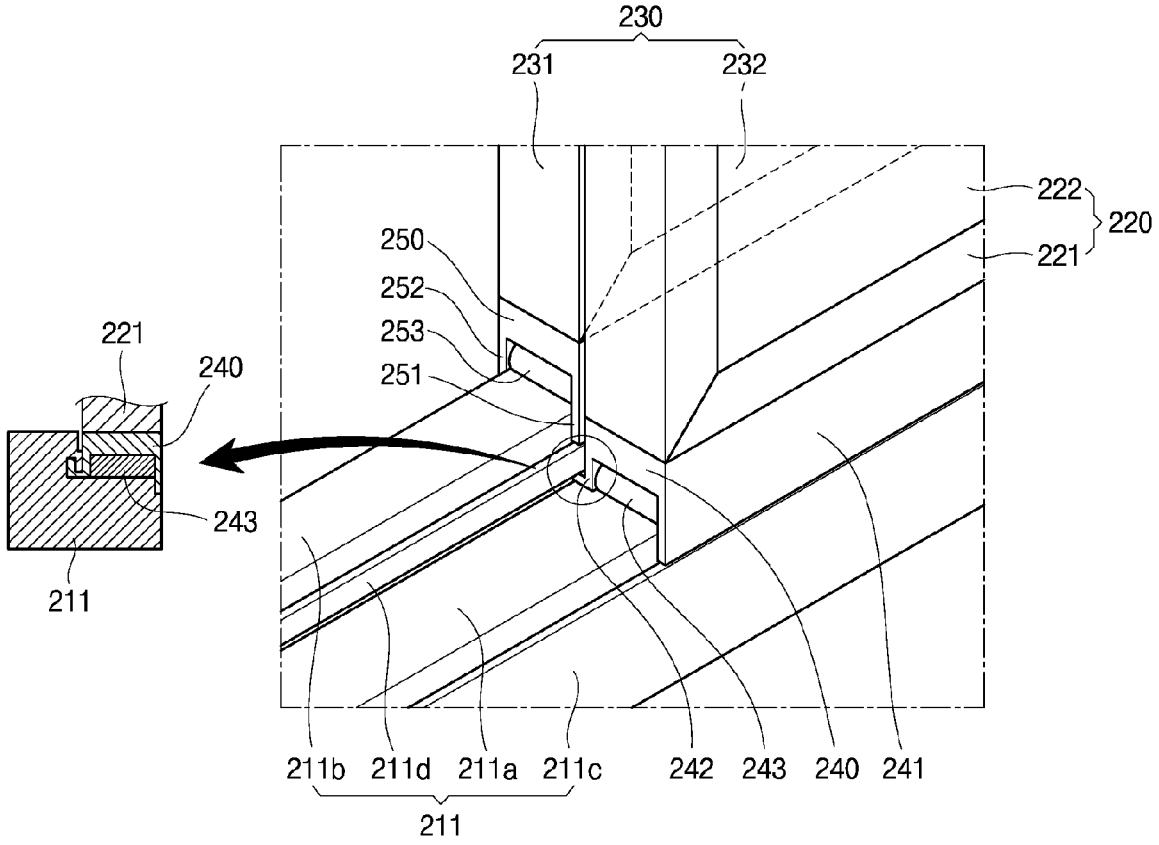
FIG. 4 illustrates an enlarged perspective cross-sectional view of a grooved part of the horizontally sliding window shown in FIG. 3.

FIG. 3 illustrates a schematic perspective view of a horizontally sliding window according to a second example of the present invention, and FIG. 4 illustrates an enlarged perspective cross-sectional view of a grooved part of the horizontally sliding window shown in FIG. 3.

A horizontally sliding window 200 according to the second example of the present invention includes a window casing 210, a first window 220, a second window 230, a first movable frame 240, and a second movable frame 250, as illustrated in FIGS. 3 and 4.

Here, the window casing 210 is mounted in an outer wall of a building and serves as a rail such that the first window 120 can move in a sliding manner via the first movable frame 240 and the second window 230 can move in a sliding manner via the second movable frame 250. The window casing 210 has a square frame shape wherein a pair of transverse frames 211 with a flat surface and a pair of longitudinal frames 212 with a flat surface are mutually assembled.

The transverse frames 211 are divided into a first rail part 211*a* disposed on an indoor side to provide a space in which the first window 220 moves in a sliding manner via the first movable frame 240; and a second rail part 211*b* that protrudes higher than the first rail part 211*a* and is disposed on an outdoor side to provide a space in which the second window 230 moves in a sliding manner via the second movable frame 250.

Since surfaces, which respectively contact the rollers 243 and 253 respectively coupled to the first and second movable frames 240, of the first and second rail parts 211*a* and 211*b* are flat, cleaning is simple and easy.

Here, the guide protrusion 211*c* protrudes from an indoor side of the first rail part 211*a*. Accordingly, the guide protrusion 211*c* serves to guide a first cover member 241 of the first movable frame 240 when the first movable frame 240 moves in a sliding manner.

In addition, a hook piece 211*d* protrudes in a "¬" shape on an indoor side of the second rail part 211*b*, preferably protrudes in an indoor side direction to be bent in the vicinity of the first rail part 211*a*.

Accordingly, the hook piece 211*d* is engaged with a second cover member 242 of the first movable frame 240 while guiding a third cover member 251 of the second movable frame 250 when the second movable frame 250 moves in a sliding manner.

The first window 220 moves in a sliding manner on the first rail part 211*a* via the first movable frame 240, thereby opening or closing a portion of an inner space of the window casing 110. The first window 220 is constituted of a square frame-shaped window frame 221 and a glass pane 222 provided inside the window frame 221.

In addition, as in the first window 220, the second window 230 moves in a sliding manner on the second rail part 211*b* via the second movable frame 250, thereby opening or closing a portion of an inner space of the window casing 110. In addition, the second window 230 is constituted of a square frame-shaped window frame 231 and a glass pane 232 provided inside the window frame 231.

Meanwhile, the first movable frame 240 is interposed between an upper portion of the first rail parts 211*a* of the transverse frames 210 and an upper end of the window frame 221 of the first window 220 and between a lower portion of the first rail parts 211*a* and a lower end of the window frame 221. The first movable frame 240 is fixed to each of upper and lower ends of the window frame 221, thereby moving in a sliding manner along the first window 220.

The first cover member 241 for covering an indoor side of the first rail part 211*a* extends from one side of the first movable frame 240, and the second cover member 242 to engage with the hook piece 211*d* of the second rail part 211*b* extends from another side of the first movable frame 240.

Here, the first cover member 241 extends straight in the vicinity of the guide protrusion 211*c* of the first rail part 211*a*, and the second cover member 242 extends straight and then is bent toward an outdoor side so as to engage with the hook piece 211*d*.

That is, since the first movable frame 240 has a structure wherein the first cover member 241 covers an indoor side of the first rail part 211*a* and the second cover member 242 is engaged with the second rail part 211*b* to move in a sliding manner, the first window 220 is not separated when the first movable frame 240 moves in a sliding manner on the first rail part 211*a*, and introduction of draft, rain, dust, and noise into an indoor side can be blocked while the first window 220 is closed.

In addition, an end of the first movable frame 240 is rotatably coupled to the first cover member 241, another end thereof is rotatably coupled to the second cover member 242, and a plurality of rollers 243 driven on the first rail part 211*a* to be in contact therewith is provided at regular intervals.

The rollers 243 are formed of rubber or high-hardness urethane to strengthen grip force to the first rail part 111*a* such that the rollers 243 can rotate in a state of being in tight contact with the first rail part 111*a* without spinning when the first movable frame 240 moves in a sliding manner.

In addition, the second movable frame 250 is respectively interposed between an upper portion of the second rail parts 211*b* of the transverse frames 210 and an upper end of the window frame 231 of the second window 230 and between a lower portion of the second rail parts 211*b* and a lower end of the window frame 231. The second movable frame 250 is fixed to each of upper and lower ends of the window frame 231, thereby moving in a sliding manner along the second window 230.

The third cover member 251 for covering an indoor side of the second rail part 211*b* extends from one side of the second movable frame 250, and a fourth cover member 252 for covering an outdoor side of the second rail part 211*b* extends from another side of the second movable frame 250.

Here, the third cover member 241 extends straight in the vicinity of a hook piece 211*d* protruding from an indoor side of the second rail part 211*b*, and the fourth cover member 242 extends straight so as to be located at almost half of an outdoor side of the second rail part 211*b*.

That is, since the second movable frame 250 has a structure wherein the third cover member 251 covers an indoor side of the second rail part 211*b* and the fourth cover member 252 covers an outdoor side of the second rail part 211*b*, the second window 230 is not separated when the second movable frame 250 moves in a sliding manner on the second rail part 211*b*, and introduction of draft, rain, dust, and noise into an indoor side can be perfectly blocked while the second window 230 is closed.

In addition, an end of the second movable frame 250 is rotatably coupled to the third cover member 251, another end thereof is rotatably coupled to the fourth cover member 252, and a plurality of rollers 253 driven on the second rail part 211*b* to be in contact therewith are provided at regular intervals.

The rollers 253 is formed of rubber or high-hardness urethane to strengthen grip force to the second rail part 111*a*, as in the rollers 243 coupled to the first movable frame 240.

[Description of Symbols]

| | | | |
|---|---|---|---|
| 100: | HORIZONTALLY SLIDING WINDOW | 110: | WINDOW CASING |
| 111: | TRANSVERSE FRAME | 111A: | GUIDE PROTRUSION |
| 112: | LONGITUDINAL FRAME | 120: | WINDOW |
| 121: | WINDOW FRAME | 122: | GLASS PANE |
| 130: | MOVABLE FRAME | 131: | FIRST COVER MEMBER |
| 132: | SECOND COVER MEMBER | 133: | ROLLER |
| 200: | HORIZONTALLY SLIDING WINDOW | 210: | WINDOW CASING |
| 211: | TRANSVERSE FRAME | 211A: | FIRST ROLLER PART |
| 211B: | SECOND ROLLER PART | 211C: | GUIDE PROTRUSION |
| 211D: | HOOK PIECE | 212: | LONGITUDINAL FRAME |
| 220: | FIRST WINDOW | 221: | WINDOW FRAME |
| 222: | GLASS PANE | 230: | SECOND WINDOW |
| 231: | WINDOW FRAME | 222: | GLASS PANE |
| 240: | FIRST MOVABLE FRAME | 241: | FIRST COVER MEMBER |
| 242: | SECOND COVER MEMBER | 243: | ROLLER |
| 250: | SECOND MOVABLE FRAME | 251: | THIRD COVER MEMBER |
| 252: | FOURTH COVER MEMBER | 253: | ROLLER |

The invention claimed is:

1. A horizontally sliding window, comprising:

a window casing formed by assembling transverse frames, which are divided into a first rail part located on an indoor side of the transverse frames and a second rail part located on an outdoor side of the transverse frames, with longitudinal frames, the window casing having a square frame;

a first window disposed on the first rail part on an inner side of the window casing;

a second window disposed on the second rail part on an outer side of the window casing;

a first movable frame interposed between an upper end of the first rail part and an upper end of the first window and between a lower end of the first rail part and a lower end of the first window, from opposite sides of which a first cover member for covering an indoor side of the first rail part and a second cover member to be coupled with the second rail part respectively extend, and including rollers rotatably coupled between the first and second cover members so as to operate in contact with the first rail part; and a second movable frame which is interposed between an upper end of the second rail part and an upper end of the second window and between a lower end of the second rail part and a lower end of the second window, from opposite sides of which a third cover member for covering an indoor side of the second rail part and a fourth cover member for covering an outdoor side of the second rail part respectively extend, and which includes rollers rotatably coupled between the third and fourth cover members so as to operate in contact with the second rail part, wherein the second rail part has a hook piece protruding in an indoor side direction of the transverse frames to be bent in the vicinity of the first rail part, and the second cover member extends straight and then is bent toward an outdoor side of the transverse frames so as to engage with the hook piece.

2. The horizontally sliding window according to claim 1, wherein a height of the second rail part of the transverse frames is higher than that of the first rail part thereof.

3. The horizontally sliding window according to claim 1, wherein a guide protrusion for guiding the first cover member when the first movable frame moves in a sliding manner protrudes from an indoor side of the first rail part.

* * * * *